US006450233B1

(12) United States Patent
Becker

(10) Patent No.: US 6,450,233 B1
(45) Date of Patent: Sep. 17, 2002

(54) CURTAIN ROD ASSEMBLY

(76) Inventor: Sharon L. Becker, P.O. Box 511656, Punta Gorda, FL (US) 33951

( * ) Notice: Subject to any disclaimer, the term of this patent is extended or adjusted under 35 U.S.C. 154(b) by 0 days.

(21) Appl. No.: 09/840,526

(22) Filed: Apr. 23, 2001

(51) Int. Cl.[7] ..... A47H 1/02
(52) U.S. Cl. ..... 160/102; 49/70
(58) Field of Search ..... 160/102, 103, 160/125, 330, 333; 49/70; 248/262, 265; 16/94 R, 96 R

(56) References Cited

U.S. PATENT DOCUMENTS 4,079,771 A * 3/1978 Theiss ..... 160/102 X
4,277,913 A * 7/1981 Castle ..... 160/90 X
4,506,477 A * 3/1985 Castle ..... 160/90 X

* cited by examiner

*Primary Examiner*—David M. Purol
(74) *Attorney, Agent, or Firm*—Holland & Knight LLP

(57) ABSTRACT

A novel curtain rod assembly for sliding glass doors or windows is provided herein, by the following novel combination of elements. The assembly includes a pair of telescoping rods surrounded by a collapsible tubular sleeve. The assembly is positioned horizontally across and spaced laterally from the sliding glass door or window frames, and expands and contracts corresponding to movement of said door or window frames. The sleeve may include corrugations wherein curtain pleats are positioned so that the pleats remain fixed and the curtains expand and contract corresponding to the rods and door or window frames.

28 Claims, 9 Drawing Sheets

CURTAIN ROD ASSEMBLY

BACKGROUND OF THE INVENTION

1. Field of the Invention

This invention relates to a curtain rod assembly for sliding glass door or window frames.

2. Description of the Background Art

Curtain rod assemblies that can be adjusted for various lengths are well known. Although curtain rods for swinging doors and windows have long been available, such rods are not practical for use on sliding glass doors or windows because of interference with the operation of the door or window assembly. Thus, either the curtain rod or a portion thereof secured to a movable door or window panel would abut against a fixed door or window panel or wall, or vice-versa, thereby blocking the movement of the movable door or window panel to its fully opened position.

There also exist a variety of embodiments of adjustable curtain rod assemblies for sliding glass doors and windows. However, existing assemblies do not prevent curtains from being trapped between rods when the rods are compressed. Such existing assemblies also do not maintain the position of curtain pleats to prevent bunching and sagging of curtains.

An adjustable curtain rod assembly was provided by U.S. Pat. No. 698,223. The patented assembly was comprised of two hollow rod of different sizes, wherein the smaller rod telescoped within the larger rod. While this rod assembly was adjustable to fit a variety of opening sizes, it was not designed for, or capable of, repetitive expansion and contraction with movements of a sliding glass door or window.

An adjustable window guard was shown in U.S. Pat. No. 933,654. This device was designed for the purpose of obstructing a window opening, and the subject patent does disclose a device comprising a series of parallel iron bars and linkages that could be adjusted to fit a variety of opening sizes. However, the assembly was designed to remain in a static position when a window is in an open as well as a closed position, and is not capable of repetitive expansion and contractions with movements of a sliding glass door. Further, it was not designed to hold curtains.

A shade and curtain hanger was disclosed in U.S. Pat. No. 1,370,817. The patented device comprised two rods having curved portions that overlap to connect the rods together. The rods could be adjusted initially for adaptation to various sized openings. However, this assembly attaches to a frame surrounding a window opening, and does not adjust once attached to such frame.

U.S. Pat. No. 2,635,685 discloses an accordion-like extensive and collapsible window screen and blind structure. The structure may be removably secured within a window frame. Although this structure adjusts in cooperation with a window as it is opened and closed, it covers a window opening only when the window is opened, and does not cover the window when the window is closed. Also, this structure does not provide for attachment of curtains to cover a window, and is not adapted for use with a sliding glass door.

A concealed horizontally extensible and contractible drapery supporting structure is disclosed in U.S. Pat. No. 3,502,132. The drapery support comprises a series of telescopically connected sections, and the drape is hung by a series of fixed and slidable hooks. A cable system operated either manually or by motor serves to extend and contract the drapery support. The drape is extended when the support is extended, and is contracted when the support is contracted. While this assembly discloses adjustable telescoping rods, the assembly is not designed to operate independently of the opening that it covers. This assembly is not attached to the underlying door or window, and is not automatically expanded and contracted when such door or window is closed or opened.

U.S. Pat. No. 3,911,990 discloses a combined window and screen device comprising a spring loaded roller, around which is wrapped a flexible screen, which roller is oriented adjacent a window frame near the edge of a slidable window. One end of the screen is attached to the roller and the opposite end is attached to an edge of the sidable window. The screen is wound and unwound corresponding to the closing and opening of the window. While this device employs an adjustable covering, it is designed to cover an opened space, rather than to gather and expand covering for a closed space. Further, this device could not readily be adapted for use with interior curtains. Also, this device does not employ collapsible tubular rods for positioning and moving the covering for the subject open space.

A curtain rod assembly for a sliding glass door is disclosed in U.S. Pat. No. 4,277,913. This assembly comprises a pair of telescoping rods, with one rod mounted on the door, and the other rod mounted independently of the door. This assembly is extended as the door is closed, and contracted as the door is opened. This assembly does not, however, include any feature designed to maintain curtain pleats, to prevent bunching of curtains, or to prevent curtains from being trapped between telescoping rods when the rods are compressed. Also, this assembly does not provide for a support to prevent sagging. Further, one of the rods in this assembly is affixed independently of the sliding glass door frames, and therefore limits flexibility regarding movement of the entire assembly relative to the sliding glass door frames.

A curtain rod for a sliding glass door is also disclosed in U.S. Pat. No. 4,506,477. This assembly incorporates the disclosure in U.S. Pat. No. 4,277,913 and further comprises a lock for preventing contraction of the assembly and thus the opening of the door.

The disclosure of the above referenced patents are incorporated by reference herein.

None of the aforementioned devices comprise a sliding glass door curtain rod assembly that has a collapsible tubular sleeve surrounding said rods to facilitate the gathering and spreading of curtains, nor do they comprise corrugations in such sleeve within which curtain pleats may be fixedly positioned. Also, none of the aforementioned devices comprise a sliding glass door curtain rod assembly having bushings or swages that prevent curtains from being trapped between rods when such rods are telescoped. The advantage of this assembly is that the curtains may be gathered and stretched without bunching or sagging, and without being trapped between the telescoping rods.

Therefore, it is an object of this invention to provide an improvement which overcomes the aforementioned inadequacies of the prior art devices and provides an improvement which is a significant contribution to the advancement of curtain rod assemblies for sliding glass doors and windows.

Another object of this invention is to provide a long lasting, low cost, easy to use curtain rod assembly for sliding glass doors and windows that does not sag or result in bunching of curtains.

Another object of this invention is to provide a curtain rod assembly for sliding glass doors and windows comprising telescoping rods mounted across and spaced laterally from door and window frames, and a sleeve surrounding the rods to facilitate gathering and spreading of curtains.

Another object of this invention is to provide a curtain rod assembly for sliding glass doors and windows wherein the assembly in an integral part of the door or window frames and expands and contracts corresponding to movements of the frames.

Another object of the invention is to provide a curtain rod assembly for sliding glass doors and windows wherein a corrugated sleeve surrounds telescoping rods, to provide for fixed positioning of curtain pleats when the rod assembly expands and contracts corresponding to movements of the door or window frames.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a novel combination of a variety of features to provide an improved curtain rod assembly for sliding glass doors and windows. These features include a long lasting, easily installed, self contained unit that does not require complex assembly or any maintenance. The use of common inexpensive elements in combination with a novel design and configuration of the components results in an assembly that may easily be manufactured at low cost. This assembly has been developed for style, ease of use, energy efficiency, privacy and appearance.

More particularly, the assembly includes telescoping curtain rods that adjust corresponding to movements of door and window frames, whereby the assembly automatically expands when the doors/windows are closed and contracts when the doors/windows are opened. The use of a collapsible tubular sleeve surrounding the rods facilitates the gathering and spreading of curtains when the doors/windows are moved. The assembly is designed so that the curtains used in connection therewith do not sag or bunch when moved.

Preferably, the collapsible sleeve comprises corrugations whereby curtain pleats are gathered when the frames are opened, and stretched out when the frames are closed. The assembly may further comprise a center support for supporting the rods. The center support may comprise a C-shaped ring whereby the curtains extend between the ends of the opening of the ring. Such ends may be equipped with guide wheels mounted thereon to guide the movement of the rods.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 16:
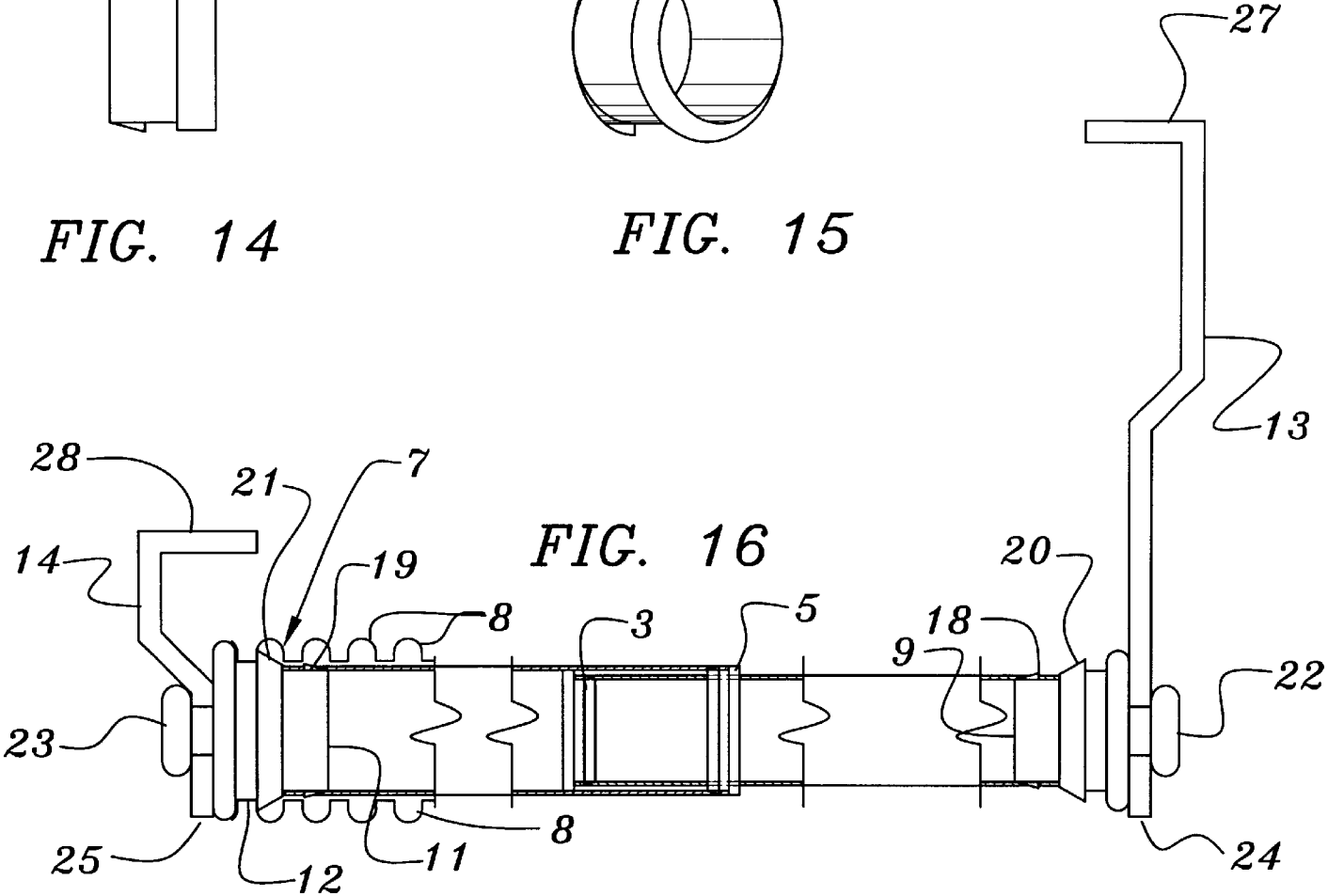
FIG. 16 is a diagram of the entire curtain rod assembly from a top view.
Figure 17:
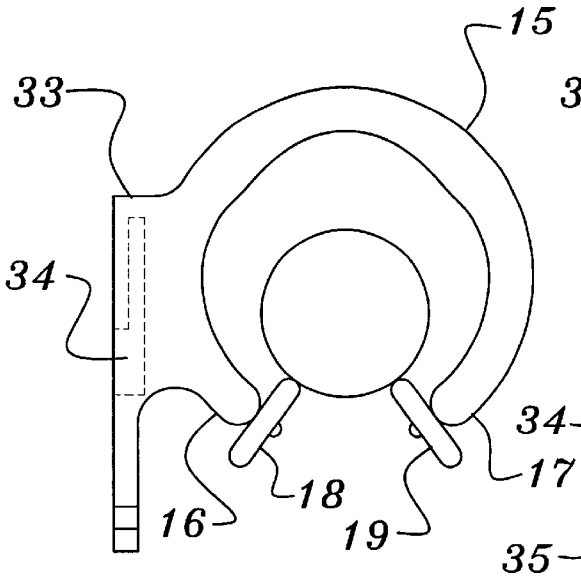
FIG. 17 is a diagram of the center support from a cross section view illustrating the placement of the curtain rods within the support.
Figure 18:
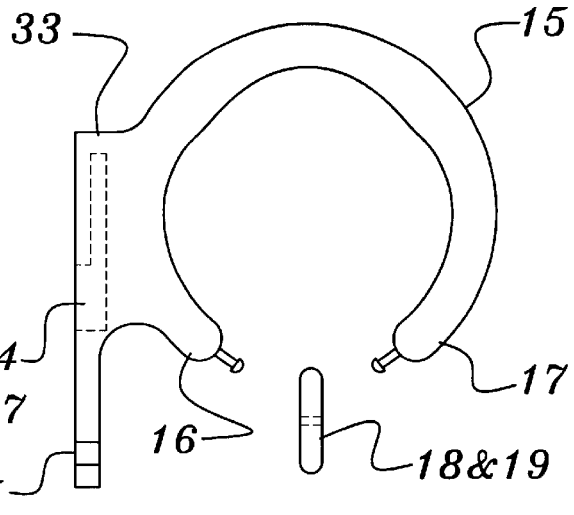
FIG. 18 and FIG. 31 are diagrams of the center support from a cross section view illustrating the configuration of the wheels for attachment to the ends of the C-shaped ring.
Figure 19:
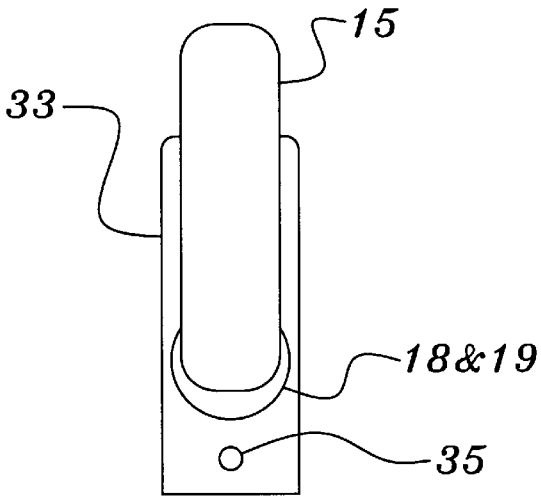
FIG. 19 is a diagram of the center support from a front view.
Figure 20:
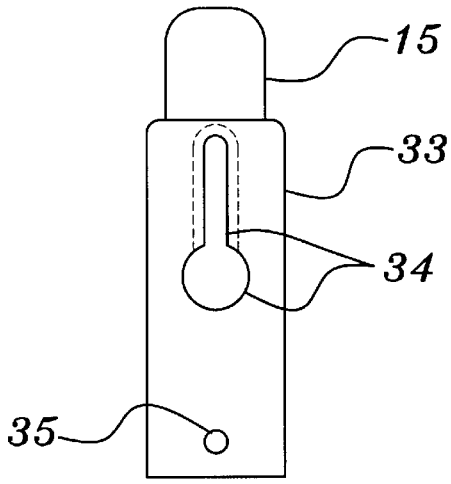
FIG. 20 and FIG. 30 are diagrams of the center support from a back view.
Figure 22:
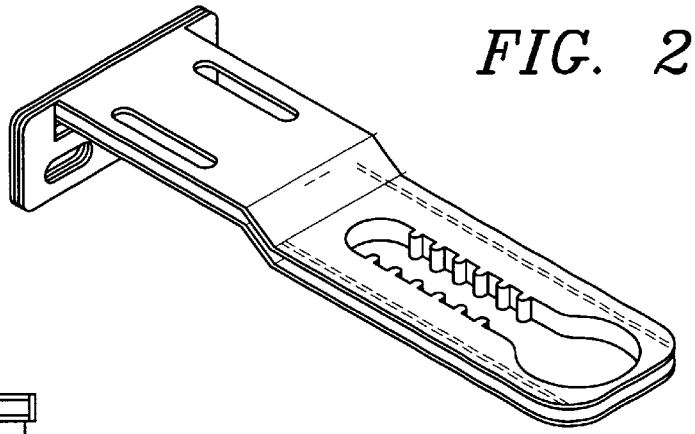
FIG. 22 is a diagram of one embodiment of the large bracket depicted from a vertical view.
Figure 21:
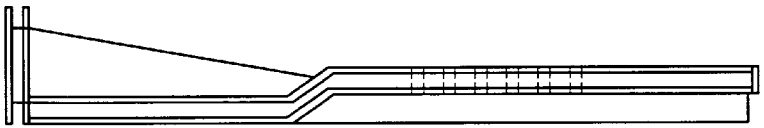
FIG. 21 is a diagram of one embodiment of the large bracket depicted from a horizontal view.
Figure 24:
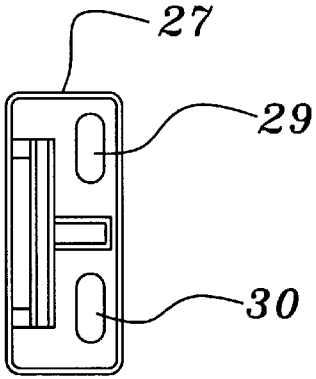
FIG. 24 is a diagram of one embodiment of the large bracket depicted from a front view.
Figure 23:
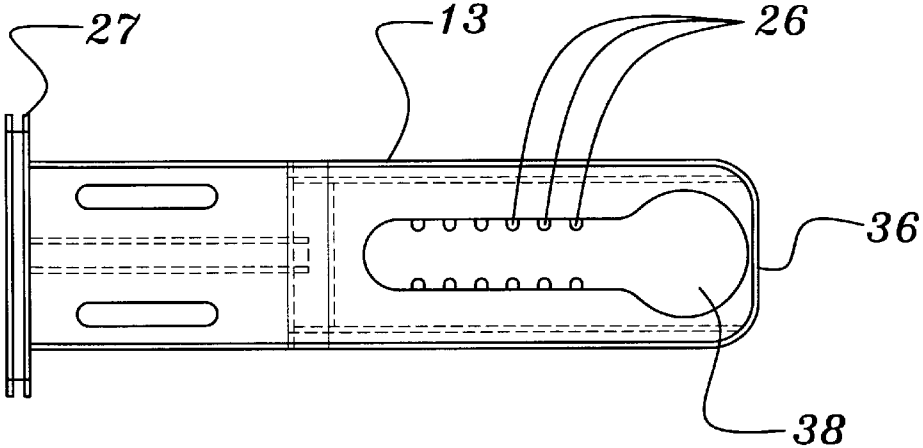
FIG. 23 is a diagram of one embodiment of the large bracket depicted from a side view.
Figure 26:
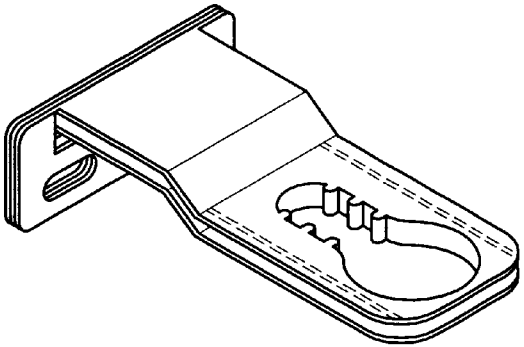
FIG. 26 is a diagram of one embodiment of the small bracket depicted from a vertical view.
Figure 28:
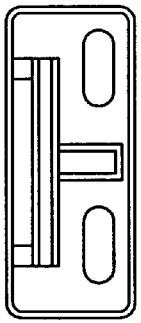
FIG. 28 is a diagram of one embodiment of the small bracket depicted from a front view.
Figure 25:
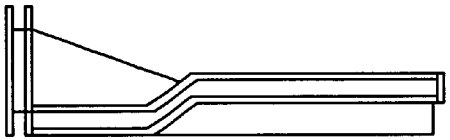
FIG. 25 is a diagram of one embodiment of the small bracket depicted from a horizontal view.
Figure 27:
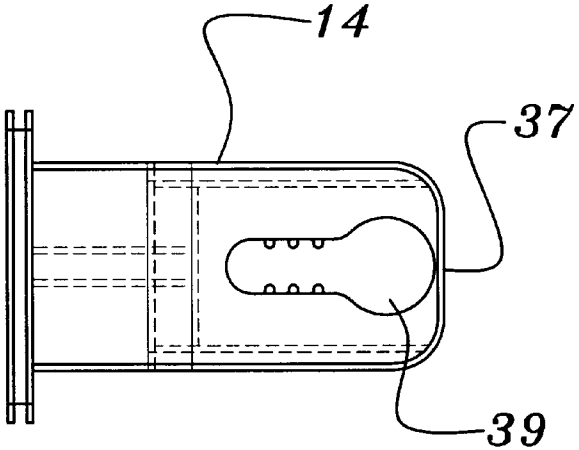
FIG. 27 is a diagram of one embodiment of the small bracket depicted from a side view.
Figure 29:
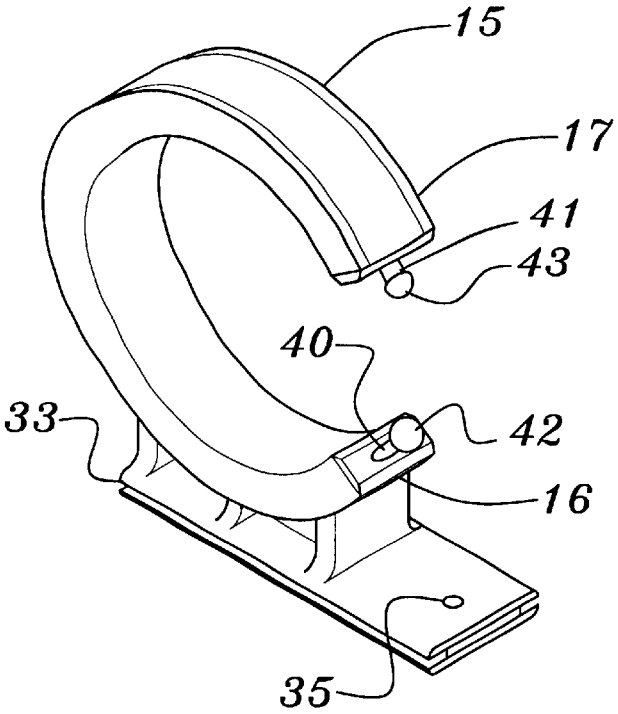
FIG. 29 is a diagram of the center support from a 45 degree angled view.
Figure 30:
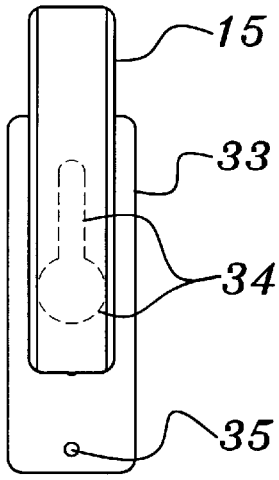
Figure 31:
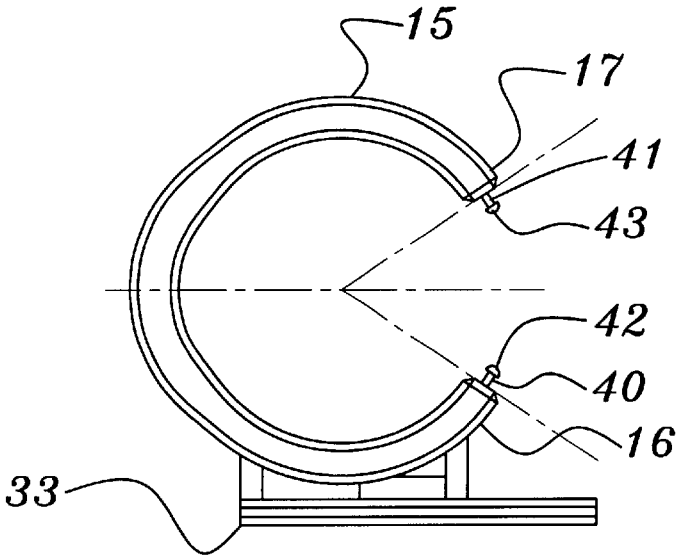
Figure 32:
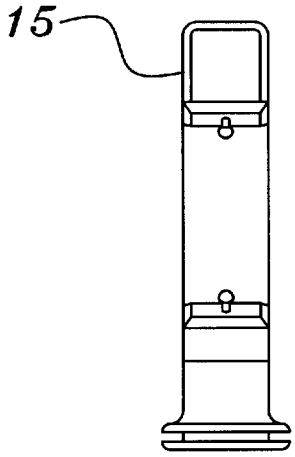
FIG. 32 is a diagram of the center support from a top view.
Figure 33:
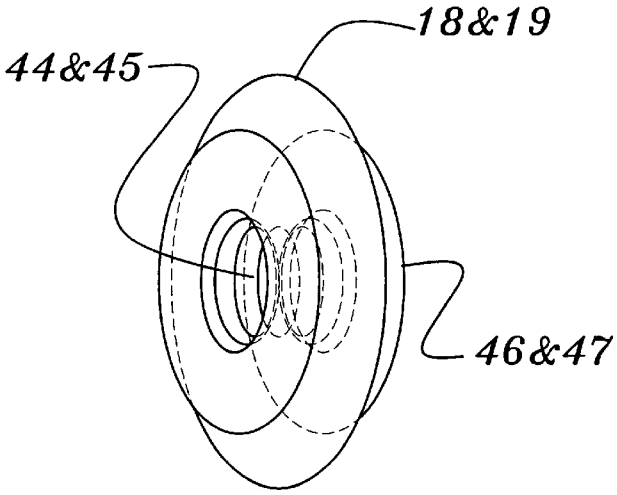
FIG. 33 is a diagram of a wheel from a 45 degree angled view.
Figure 36:
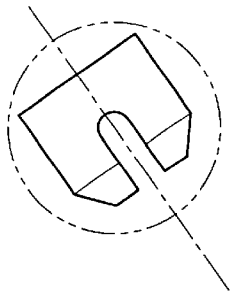
FIG. 36 is a partial exploded view of one of the axles on which one of the wheels is journalled.
Figure 34:
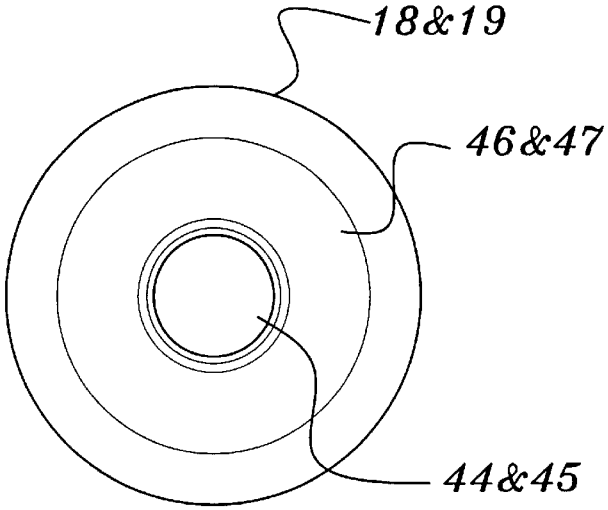
FIG. 34 is a diagram of a wheel from a side view.
Figure 35:
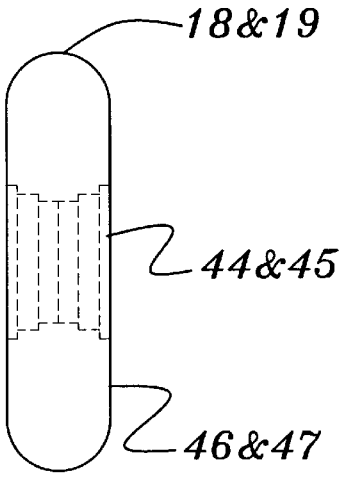
FIG. 35 is a diagram of a wheel from a cross section view.

As shown in FIG. 16, the curtain rod assembly comprises a large rod 1 and a small rod 2 each having a first end (12 and 10) and a second end (6 and 4). An inner bushing 3 fits within the second end 4 of the small rod 2. A reducer bushing 5 fits within the second end 6 of the large rod 1. In an alternate embodiment, in lieu of the inner bushing 3 and reducer bushing 5, the second end 4 of the small rod 2 and the second end 6 of the large rod 1 may be swaged.

A collapsible tubular sleeve 7 surrounds rods 1 and 2. Said sleeve may have corrugations 8. A small socket 9 fits within the first end 10 of the small rod 2. A large socket 11 fits within the first end 12 of the large rod 1.

Figure 1:
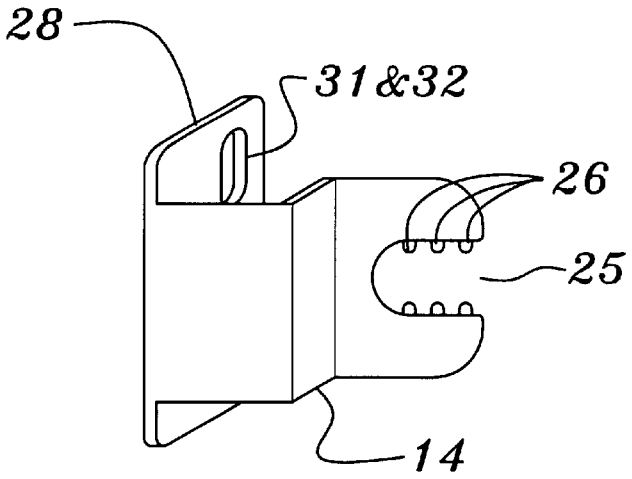
FIG. 1 is a diagram of one embodiment of the small bracket depicted from a side view.
Figure 2:
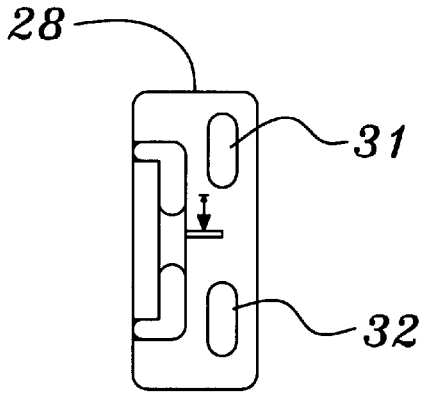
FIG. 2 is a diagram of one embodiment of each of the small and large brackets depicted from a front view.
Figure 3:
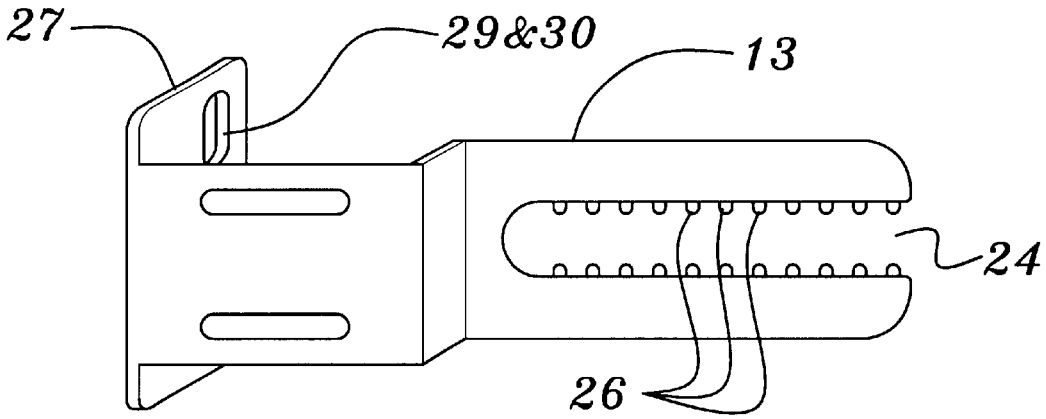
FIG. 3 is a diagram of one embodiment of the large bracket depicted from a side view.
Figure 4:
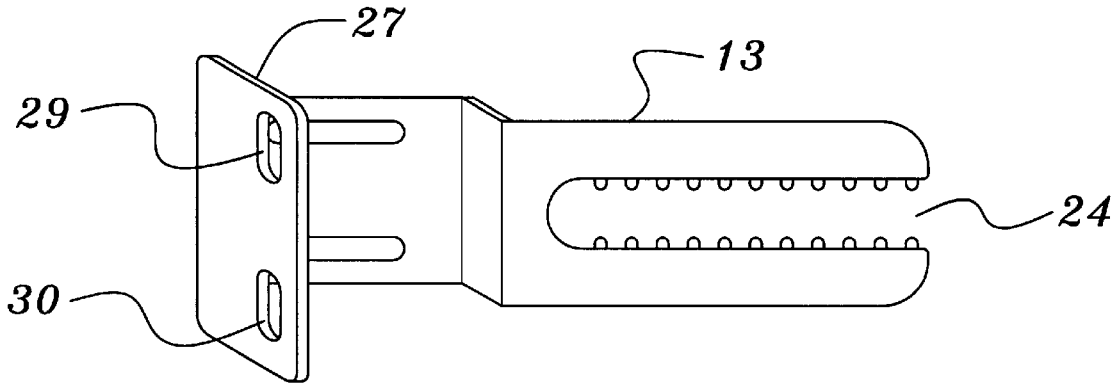
FIG. 4 is a diagram of one embodiment of the large bracket depicted from a side view.
Figure 5:
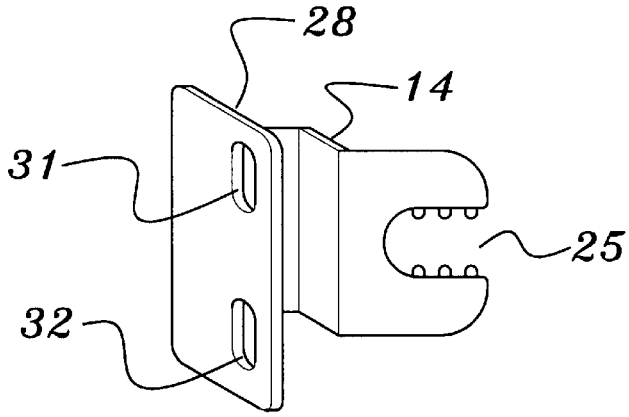
FIG. 5 is a diagram of one embodiment of the small bracket depicted from an inside view.
Figure 6:
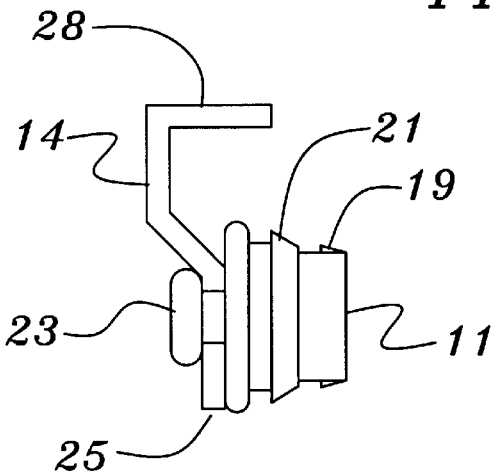
FIG. 6 is a diagram of one embodiment of the small bracket and an end plug depicted from a top view.
Figure 7:
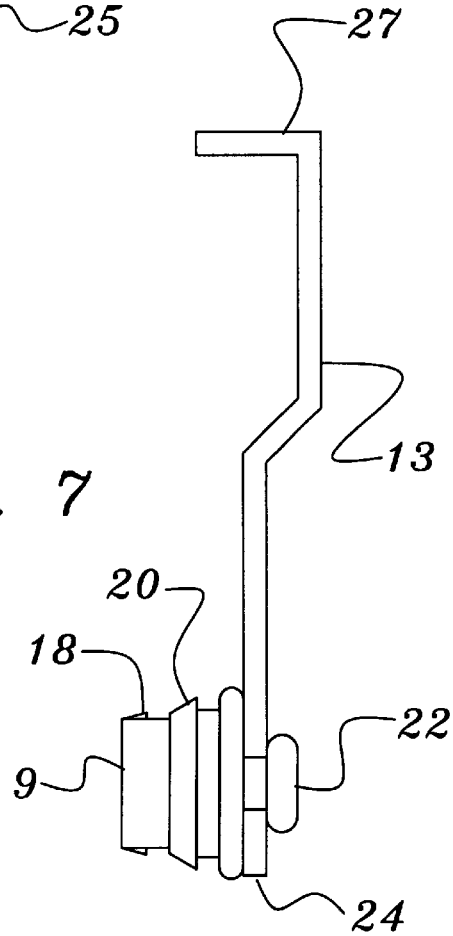
FIG. 7 is a diagram of one embodiment of the large bracket and an end plug depicted from a top view.
Figure 8:
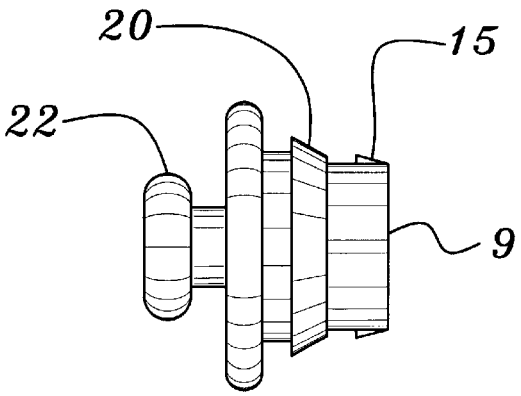
FIGS. 8 and 9 are diagrams of the end plugs depicted from a side view.
Figure 9:
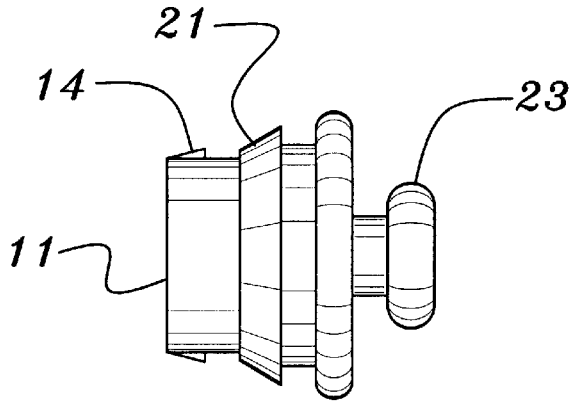
Figure 10:
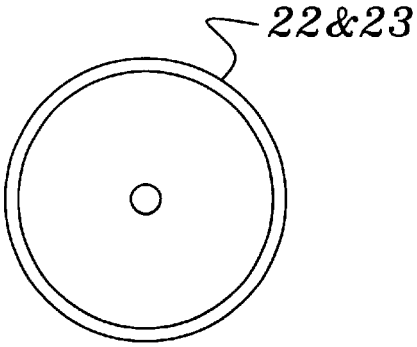
FIG. 10 is a diagram of an end plug depicted from an end view.
Figure 11:
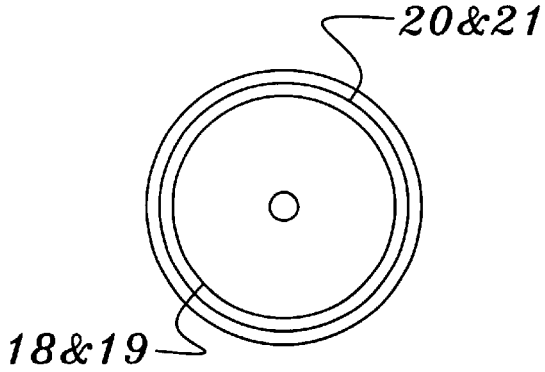
FIG. 11 is a diagram of an end plug depicted from an end view.

The foregoing components may be fixed to sliding door or window frames by a large bracket 13 and a small bracket 14, wherein the small socket 9 is attached to the large bracket 13, and the large socket 11 is attached to the small bracket 14. The large bracket 13 and small bracket 14 each may include a base 27 and 28. As shown in FIG. 1. through FIG. 5, each of the bases 27 and 28 may include a pair of holes 29 through 32, through which conventional screws may be used to attach the brackets 13 and 14 to the door or window frames.

As shown in FIG. 17 through FIG. 20, the curtain rod assembly may further comprise a center support attached opposite the small bracket 14 relative to the door or window frame for supporting the assembly. The center support may comprise a C-shaped ring 15 having a first end 16 and a second end 17. Curtains extend between ends 16 and 17. The center support may further comprise a first guide wheel 18 and second guide wheel 19 attached to said first end 16 and second end 17, respectively. As shown in FIGS. 29, 31, 35 and 36, in one embodiment, the first and second guide wheels 18 and 19 may be mounted on the first and second ring ends 16 and 17 using a first axle 40 and a second axle 41. Such axles 40 and 41 have end faces 42 and 43, respectively. Through the center 44 and 45 of each guide wheel 18 and 19, axles 40 and 41 may extend therethrough, so that the end faces 42 and 43 of said axles are flush with the outer surfaces 46 and 47 of said guide wheels 18 and 19.

The center support may include a base 33, which base may have a slot 34 and a hole 35, with which conventional screws may be used to attach the base 33 to the door or window frame.

As shown in FIG. 8 through FIG. 11, sockets 9 and 11 may comprise end plugs. The end plugs 9 and 11 may each include a pair of inner circumferential barbs 18 and 19, and outer circumferential barbs 20 and 21, for securing the tubular sleeve 7 to the telescoping rods 1 and 2, whereby the sleeve 7 is stretched open when the rods 1 and 2 are extended. Each end plug 9 and 11 may include a boss 22 and 23 for engaging the large and small brackets 13 and 14.

A means for attaching the end plugs 9 and 11 to the brackets 13 and 14 may be included. As shown in FIGS. 1, 3, 4 and 5, said means may comprise a large slot 24 in the large bracket 13, and a small slot 25 in the small bracket 14. Each slot 24 and 25 may have teeth 26 for engaging a boss 22 or 23 at various depths within said slot to vary the distance of the rods 1 and 2 from the door or window frames. As shown in FIGS. 22, 23, 26, and 27, in an alternate embodiment, said large bracket 13 may have a closed end 36, and said small bracket 14 may have a closed end 37, so that each slot 24 and 25 includes a circular space 38 and 39. The boss 22 or 23 of each end plug 9 or 10 fits within the corresponding circular space 38 or 39 for further insertion into said slot 24 or 25. The closed ends 36 and 37 operate to prevent rods 1 and 2 from being pulled out of brackets 13 and 14.

Figure 12:
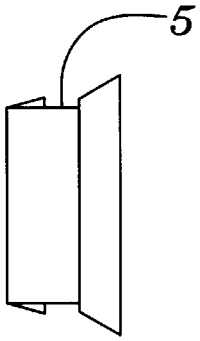
FIG. 12 is a diagram of the reducer bushing depicted from a side view.
Figure 13:
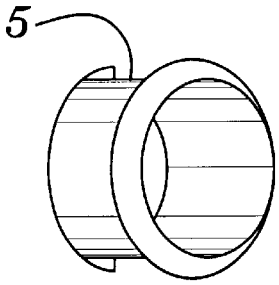
FIG. 13 is a diagram of the reducer bushing depicted from an end view.
Figure 15:
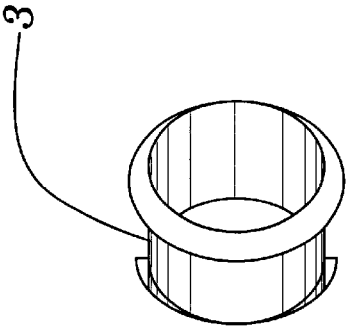
FIG. 15 is a diagram of the inner bushing depicted from an end view.
Figure 14:
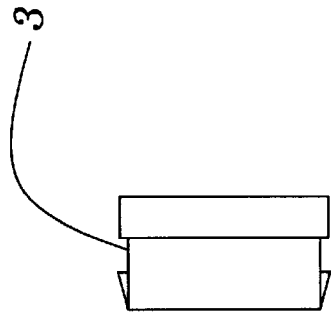
FIG. 14 is a diagram of the inner bushing depicted from a side view.

As shown in FIGS. 12, 13 and 16, the assembly may include an inner bushing 3 positioned within the second end 4 of the small rod 2. As shown in FIGS. 14, 15 and 16, the assembly may include a reducer bushing 5 positioned within the second end 6 of the large rod 1. In an alternate embodiment, in lieu of the inner bushings and reducer bushing 5, the second end 4 of the small rod 2 and the second end 6 of the large rod 1 may be swaged.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A curtain rod assembly for sliding frames, comprising a large rod section having a first and second end, wherein the first end is attached to the frame;

a small rod section having a first and second end in axial alignment with said large rod, and having an extensible telescoping fit within the second end of said large rod, wherein the first end of said small rod is attached to the frame opposite said large rod, and wherein said rods are mounted horizontally across the frames so that said rods are spaced laterally from the frames; and a collapsible tubular sleeve surrounding said rods to facilitate the gathering and spreading of curtains mounted thereto when the frames are slid open and closed.

2. A curtain rod assembly as set forth in claim 1, wherein said collapsible sleeve comprises corrugations.

3. A curtain rod assembly as set forth in claim 2, wherein said curtain further comprises curtain pleats fixedly positioned within said corrugations of said sleeve, whereby said pleats are gathered when the frames are slid open, and are stretched out when the frames are slid closed.

4. A curtain rod assembly as set forth in claim 2, wherein said sleeve has a first end and a second end, and further comprising a socket positioned within the first ends of each of said large and small rods, respectively, for securing the first end of said sleeve to the first end of said small rod and for securing the second end of said sleeve to the first end of the said large rod, thereby assuring that said sleeve is fully stretched open when said rods are fully extended.

5. A curtain rod assembly as set forth in claim 4, wherein said sockets each include a pair of circumferential barbs for engaging into said corrugations of said sleeve.

6. A curtain rod assembly as set forth in claim 5, wherein said sockets comprise end plugs, and further comprising a large bracket and a small bracket for mounting said rods across the frame s for attaching to respective opposite ends of the frames with the end plug positioned within said small rod being attached to said large bracket and the end plug positioned within said large rod being attached to said small bracket.

7. A curtain rod assembly as set forth in claim 1, further comprising a reducer bushing positioned within the second end of said large rod.

8. A curtain rod assembly as set forth in claim 1, further comprising an inner bushing positioned within the second end of said small rod.

9. A curtain rod assembly as set forth in claim 1, further comprising a center support attached opposite said small bracket relative to the frame, for supporting said rods.

10. A curtain rod assembly as set forth in claim 9, wherein said center support comprises a C-shaped ring having a first and second end whereby the curtains extend between said ends.

11. A curtain rod assembly as set forth in claim 10, further comprising a first and second guide wheel mounted on each said end of said C-shaped ring, which guide wheels each have an inner surface adjacent said ring ends and an outer surface facing the curtains.

12. A curtain rod assembly as set forth in claim 1, further comprising an end plug positioned within the first end of each of said large and small rods; and a large bracket and a small bracket attached to opposite ends of the frames for mounting said rods across the frames with said end plug within said small rod being attached to said large bracket and said end plug within said large rod being attached to said small bracket, each said brackets including means for attaching said end plugs to said brackets at varying distances from the frames.

13. A curtain rod assembly as set forth in claim 12, wherein said attaching means of each said bracket comprises a slot having teeth that engages a boss of each of said end plugs at various depths within said slot to vary the distances from the frames.

14. A curtain assembly including opposing pairs of rod assemblies as set forth in claim 1 between which is positioned the curtain.

15. A sliding glass assembly comprising sliding glass frames and further comprising a curtain rod assembly as set forth in claim 1 connected to the sliding glass frames.

16. A curtain rod assembly as set forth in claim 2, further comprising a reducer bushing positioned within the second end of said large rod.

17. A curtain rod assembly as set forth in claim 2, further comprising an inner bushing positioned within the second end of said small rod.

18. A curtain rod assembly as set forth in claim 2, further comprising a center support attached opposite said small bracket on the frame, for supporting said rods.

19. A curtain rod assembly as set forth in claim 3, further comprising a reducer bushing positioned within the second end of said large rod.

20. A curtain rod assembly as set forth in claim 3, further comprising an inner bushing positioned within the second end of said small rod.

21. A curtain rod assembly as set forth in claim 1, wherein the second end of said large rod is swaged.

22. A curtain rod assembly as set forth in claim 1, wherein the second end of said small rod is swaged.

23. A curtain rod assembly as set forth in claim 2, wherein the second end of said large rod is swaged.

24. A curtain rod assembly as set forth in claim 2, wherein the second end of said small rod is swaged.

25. A curtain rod assembly as set forth in claim 3, wherein the second end of said large rod is swaged.

26. A curtain rod assembly as set forth in claim 3, wherein the second end of said small rod is swaged.

27. A curtain rod assembly as set forth in claim 12, wherein said means of attaching each said bracket comprises a closed end forming a closed slot within said bracket;

a C-shaped space within the closed end of each said bracket, and teeth that engage a boss of each of said end plugs at various depths within said slot to vary the distances of said rods from the frames.

28. A curtain rod assembly as set forth in claim 11 further comprising an axle having an end face extending from each end of said C-shaped ring, wherein each said guide wheel is mounted on an axle so that the axle extends through the center of said wheel and the end face of the axle is flush with the outer surface of said wheel.

* * * * *